US005225304A

United States Patent [19]

Kabashima et al.

[11] Patent Number: 5,225,304

[45] Date of Patent: Jul. 6, 1993

[54] POSITIVE-ELECTRIFICATION TONER

[75] Inventors: Hirotaka Kabashima; Hiroyuki Takagiwa, both of Hachioji; Kunio Akimoto, Fujisawa; Tatsuya Nagase, Hamura, all of Japan

[73] Assignee: Konica Corporation, Tokyo, Japan

[21] Appl. No.: 712,671

[22] Filed: Jun. 10, 1991

[30] Foreign Application Priority Data

Jun. 12, 1990 [JP] Japan ..... 2-151525

[51] Int. Cl.[5] ..... G03G 9/10

[52] U.S. Cl. ..... 430/110; 430/109; 430/111

[58] Field of Search ..... 430/110, 109, 111

[56] References Cited

U.S. PATENT DOCUMENTS 4,950,573 8/1990 Yamaguchi et al. ..... 430/109

*Primary Examiner*—Marion E. McCamish
*Assistant Examiner*—Mark A. Chapman
*Attorney, Agent, or Firm*—Finnegan, Henderson, Farabow, Garrett & Dunner

[57] ABSTRACT

A positive-electrification toner capable being fixed with a hot roller having a fluoro-resin covering layer is disclosed. The toner comprises mother particles containing a resin and a coloring agent, and vinyl resin fine particles fastened to the mother particles by mechanical impact force, wherein the resin has a softening point higher than that of the resin contained in the mother particles and not higher than 160° C. and the vinyl resin fine particles have a frictional negative electrification quantity against iron powder not larger than 100 μc/g. The toner is used for electrophotography, electrostatic printing and electroststic recording.

9 Claims, 1 Drawing Sheet

POSITIVE-ELECTRIFICATION TONER

Figure 1:
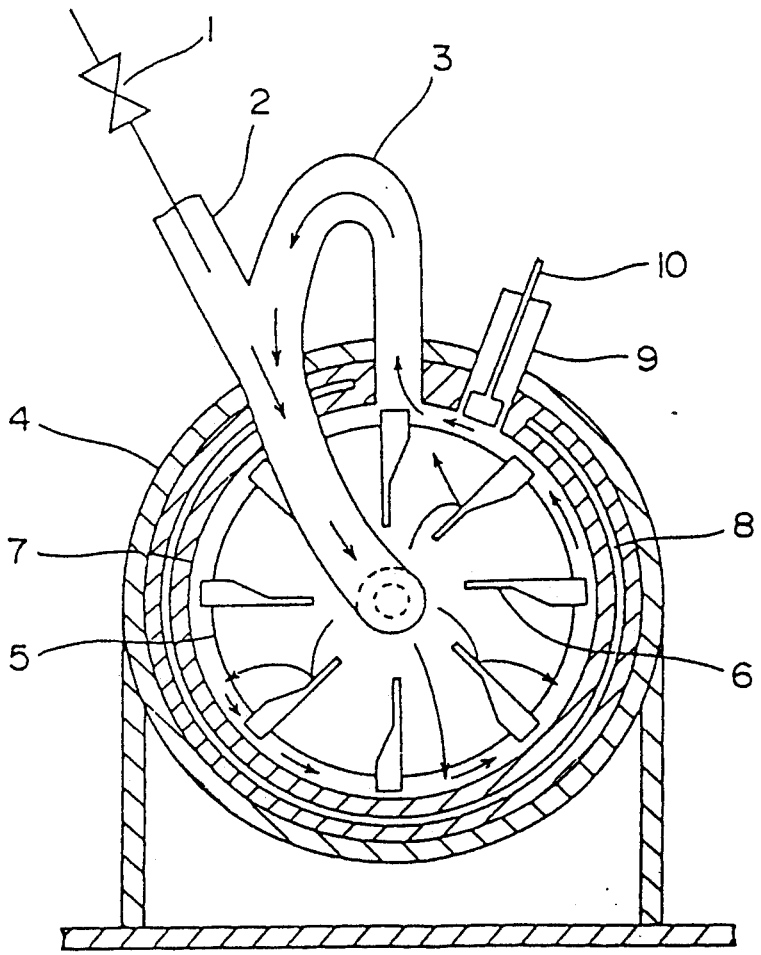

The present invention relates to a positive-electrification toner applicable to electrophotography, electrostatic printing and electrostatic recording, specifically to a positive-electrification toner capable of being fixed with a hot roller having a fluororesin covering layer.

In electrophotography, for example, a visible image is formed generally by steps of forming an electrostatic latent image on a latent image-carrying member through electrification and exposure, developing the latent image with a toner consisting of fine particles of binder resin containing a colorant, and then, transferring and fixing the toner image on a support such as transfer paper.

As described above, fixing of a toner image is a necessary step to obtain a visible image, and the hot roller fixing method has come to be widely used for its high thermal efficiency and capability of high-speed fixing.

Toners used in said hot roller fixing method are needed to satisfy requirements for antiblocking property, cleaning property as well as low temperature fixability and anti-offsetting capability.

To improve these properties, there have been proposed the following techniques.

A first technique is to use, as binder resin for toner, a block copolymer or graft copolymer of a crystalline polyester and an amorphous vinyl polymer having a ratio of weight-average molecular weight Mw to number-average molecular weight Mn (Mw/Mn) of 3.5 or more (Japanese Patent O.P.I. Publication No. 27855/1988), and a second technique is to use, as a binder resin for toner, a block copolymer or graft copolymer of a crystalline polyester and an amorphous vinyl polymer having two or more peaks in its molecular weight distribution (Japanese Patent O.P.I. Publication No. 27856/1988).

However, the above techniques have disadvantages of causing poor cleaning, poor developer conveyance and poor frictional electrification since the crystalline polyester component, a constituent of the copolymer, tends to film on the surface of a latent image-carrying member or developer-carrying member. As a result, uneven image density, image blurring and fogging are generated in the images obtained.

Moreover, such a toner is liable to aggregate in a developing unit and cause image defect which appears as white line attributable to toner aggregates.

Particularly, in case that the latent image-carrying member is made of an organic photoconductive photoreceptor, paper dust generated from transfer paper, deposits of rosin and talc, and corona discharged products generated by a corona discharger in the image forming apparatus are liable to adhere on the surface of the organic photoconductive photoreceptor; moreover, the above crystalline polyester component is also apt to adhere to the surface of the organic photoconductive photoreceptor. Such adhering matters on the surface absorb moisture under high temperature and high humidity conditions and lowers the resistance; thereby a latent image on said portion is deteriorated, causing image failure in a visible image formed.

On the other hand, there is proposed the following technique to improve cleaning property and frictional electrification by preventing the toner from filming and aggregating.

The technique is to bury, around the surface of heat-fixable mother particles, resin fine particles having a softening point higher than that of said mother particles and an average particle size larger than 0.1 μm and smaller than ¼ that of said mother particles (Japanese Patent O.P.I. Publication No. 131149/1988).

However, this technique has the following problems. That is, in fixing a positive-electrification toner by the hot roller fixing method, it is preferable that the surface of the hot roller be covered with a fluororesin such as polytetrafluoroethylene (PTFE) or tetrafluoroethylene-perfluoroalkyl vinylether copolymer (PFA); but these fluororesins are apt to attract electrostatically a positive-electrifiable toner to the surface of the hot roller and to cause electrostatic offsetting, since these resins have a strong tendency of negative electrification. In this technique, however, highly positive-electrifiable resin fine particles for positive-electrification toner are buried. Accordingly, the above-mentioned electrostatic offsetting increases much more, and as a result, there arise various problems such as winding of transfer paper around the hot roller, appearance of conspicuous marks of a fixing unit's separation nail in a fixed toner image, and surface stain of the hot roller with the toner which leads to image failure.

Further, when this technique is used in a 2-component developer, resin fine particles buried around the surface of mother particles are liable to move to a carrier, because the frictional electrification of the resin fine particles is greatly different from that of the carrier. As a result, the resin fine particles electrostatically adhere to the surface of the carrier, lowering electrifying capability of the carrier and impairing durability thereof.

There is also known a technique to fasten and bury, by mechanical impact force, negative-electrification resin fine particles in positive-electrification mother particles containing binder resin (Japanese Patent O.P.I. Publication No. 196070/1989).

In this technique, negative-electrification resin fine particles are fastened and buried in mother particles by mechanical impact force, and the negative-electrification resin fine particles used consist of fluorine-containing vinyl resins such as polyvinylfluoride (PVF), polytetrafluoroethylene (PTFE) and polyvinylidene fluoride (PVDF); therefore, the softening point of these resin fine particles is too high to have an adequate low temperature fixability.

Moreover, because of high softening point of the negative-electrification resin fine particles, it is difficult to fasten and bury these resin particles by mechanical impact force on the surface of the mother particles. Consequently, a large number of resin fine particles exist separately from the mother particles, and thereby the frictional electrification and durability of toner are lowered.

SUMMARY OF THE INVENTION

The present invention is made in response to the above circumstances. Accordingly, it is an object of the present invention to provide a positive-electrification toner which is capable of being fixed with a hot roller having a fluororesin covering layer, and high in capabilities of low temperature fixing, antiblocking, anti-offsetting, cleaning and antistatic offsetting, in addition to having an excellent durability.

The positive-electrification toner of the invention comprises (1) mother particles containing a resin and a coloring agent, in which resin a crystalline polyester and an amorphous vinyl polymer are chemically bonded and (2) vinyl resin fine particles, fastened to the above mother particles by mechanical impact force wherein the resin has a softening point higher than that of a binder resin contained in the mother particles and not higher than negative electrification quantity against iron powder larger than 100 $\mu c/g$ in an absolute value.

In the invention, the toner is prevented from adhering elecrostatically to the surface of the fluororesin-covered hot roller, by selecting appropriately the softening point and frictional electrification quantity of resin fine particles to be fastened to mother particles, while trying to maintain the toner's low temperature fixability on a good level.

To be in detail, since the upper limit of the softening point is 160° C., the surface of the resin fine particles is softened by heat and becomes easy to fuse on the surface of the mother particles when the resin fine particles are mixed with the mother particles and subjected to mechanical impact; thereby adhesion of the resin fine particles to the surface of the mother particle is greatly strengthened; thus, there is obtained a positive-electrification toner in which the resin fine particles are firmly fastened to the surface of the mother particles, without impairing the low temperature fixability and low temperature demolding capability.

Even if the resin fine particles liberate themselves from the mother particles and adhere to the surface of carrier or developer-carrying member, it has no substantial effect on the frictional electrification of this positive-electrification toner, because the negative electrification quantity of the resin fine particles is prescribed in an absolute value as mentioned above. This also contributes to improve the frictional electrification and durability of said positive-electrification toner.

When fixed with a fluororesin-covered hot roller, the mother particles do not electrostatically transfer, together with the resin fine particles, to the fluororesin-covered hot roller since the resin fine particles having a strong negative-electrification are firmly fastened to the mother particles. Accordingly, there occur none of toner stain on a hot roller, winding of transfer paper around a fixing roller, and appearance of a fixing unit's separation nail mark in a fixed toner image.

Next, the constitution of the invention is described in detail.

The resin fine particles constituting the positive-electrification toner of the invention consist of a vinyl resin, which has a softening point $T_2$ higher than that of a binder resin $T_1$ contained in the mother particles and not higher than 160° C. and the fine particles have a negative frictional electrification quantity against iron powder larger than 100 $\mu C/g$ in an absolute value.

In the invention, softening point $T_1$ of a binder resin contained in the mother particles and softening point $T_2$ of the resin fine particles are those measured with a descending-type flow tester (manufacture by Shimazu Corp.), by steps of applying a load of 20 kg/cm$^2$ with a plunger to a 1 cm$^3$ of sample heated at a temperature rising speed of 6° C./min, pressing a nozzle having a diameter of 1 mm and length of 1 mm thereto to draw a plunger-descending-quantity to temperature curve (softening flow curve), and taking a temperature corresponding to h/2 as softening point, when the height of this S-shaped curve is defined as h.

When the softening point of the resin fine particles meets the condition of $T_1 < T_2 \leqq 160°$ C. according to the invention, the resin fine particles can be firmly fastened by mechanical impact force to the surface of the mother particles, and the toner can be firmly fixed at a reduced prescribed temperature of the fluororesin-covered hot roller.

However, when softening point $T_2$ of the resin fine particles is lower than softening point $T_1$ of the binder resin contained in the mother particles, the resin fine particles are heavily deformed, and an adequate antifilming property and antiblocking property cannot be obtained. The softening point $T_2$ is preferably 10°-60° C. higher than the softening point $T_1$ for this purpose. The softening point $T_1$ is preferably 90°-130° C. to improve the low temperature fixability, antioffset and antifilming properties.

On the contrary, softening point $T_2$ of the resin fine particles higher than 160° C. leads to a poor low temperature fixability and poor demolding capability of a toner.

In the invention, the frictional electrification quantity of the resin fine particles against iron powder is that which is obtained by steps of placing 19.92 g of iron powder TEFV 200/300 (product of Powder Tech.) and 0.08 g of said resin fine particles in a 20-ml glass sample tube, allowing the content to stand for 2 hours in an environment of 20±2° C., 60±5% RH, shaking the tube for 20 minutes with a shaker Mini Paper (product of Tokyo Rikaki), and then measuring the electrification quantity by the blowoff method (pressure: 0.5 kg/cm$^2$, time: 30 sec, mesh: #400).

When the negative frictional electrification quantity of the resin fine particles against iron powder is not less than 100 $\mu C/g$ in an absolute value, electrostatic offsetting can be adequately prevented.

When the negative frictional electrification of the resin fine particles against iron powder is less than 100 $\mu C/g$ in an absolute value, however, there occurs an image stain due to electrostatic offsetting.

The negative frictional electrification quantity in an absolute value is preferably not more than 200 C/g for positive electrification of toner particles.

On the other hand, a positive frictional electrification of the resin fine particles causes a large electrostatic offsetting, yielding heavily stained images.

The resin fine particles used in the invention are of vinyl-type resins such as styrene resin, acrylic resin and styrene-acrylic copolymer. Preferable resin types of the resin fine particles are styrene/methyl methacrylate/n-butylacrylate copolymer and styrene/methyl methacrylate/n-butyl acrylate/methacrylic acid copolymer.

As described above, the resin fine particles used in the invention satisfy requirement of $T_1 < T_2 \leqq 160°$ C. in respect to its softening point $T_2$, and have a negative frictional electrification quantity against iron powder not less than 100 $\mu C/g$ in an absolute value. Such vinyl-type resins are manufactured by the following methods.

(a) A method of manufacturing a vinyl-type resin which adopts emulsion polymerization or soap-free emulsion polymerization using no emulsifier, and is carried out in the presence of a persulfate catalyst such as ammonium persulfate or potassium persulfate or an azo-type catalyst such as azobiscyanovalerianic acid to utilize the anionicity of a fragment of said catalyst.

(b) A method of manufacturing a vinyl-type resin which adopts emulsion polymerization or soap-free emulsion polymerization using no emulsifier, and uses a functional monomer having an anionic group such as carboxyl group or sulfonic acid group as a copolymerization component to introduce anionicity.

(c) Combination of the above (a) and(b). This method is useful when (a) or (b) alone cannot provide enough magnitude of negative frictional electrification.

Glass transition point Tg of the resin fine particles used in the invention is preferably not less than 55° C., for enhancing toner's anti-blocking property.

The average size of the resin fine particles before being fastened to the mother particles is preferably 0.02 to 0.6 μm, for the purpose of heightening the adhesion of the resin fine particles to the mother particles.

Here, "the average size of the resin fine particles before fastening" is an average of values measured by observation at a magnifying power of tens of thousands with a scanning electron microscope.

The covered ratio of the mother particles with the resin fine particles is preferably within a range of 10 to 90%, in order to have the resin fine particles function effectively. The covered ratio is given by the following expression.

$$\frac{50\rho_t D_t^3 C\left(1-\frac{\sqrt{D_t(D_t+2D_p)}}{D_t+D_p}\right)}{\rho_p(100-C)D_p^3}$$

wherein $\rho_t$: specific gravity of the mother particles $\rho_p$: specific gravity of the resin fine particles $D_t$: size of the mother particles $D_p$: size of the resin fine particles C: concentration of the resin fine particles (%)

The mother particles used in the invention contain, as binder, a resin in which a crystalline polyester and an amorphous vinyl polymer are chemically bonded.

It is preferable that the amorphous vinyl polymer possess a functional group capable of bonding with a crystalline polyester used together, and that the ratio of the vinyl polymer's weight-average molecular weight Mw to that of number-average molecular weight Mn (Mw/Mn) be not less than 3.5, particularly be 7 to 30.

Preferable functional groups are carboxyl, hydroxyl, amino and epoxy groups.

The amorphous vinyl polymer used in the invention is synthesized from a composition for polymerization containing monomers having the above functional group, but the principal chain portion which constitute the frame of said amorphous vinyl polymer is not particularly limited in polymer types. Examples of such vinyl polymers include polystyrene, polymethylmethacrylate, polymethylacrylate, polyvinyl chloride, polyvinyl acetate, polyacrylonitrile, and the like. Among them, a styrene-type polymer, acryl-type polymer and styrene-acryl-type polymer are particularly preferred.

Further, it is preferable that the amorphous vinyl polymer have at least two maximum values in its molecular weight distribution/ in view of a high low temperature fixability and high anti-offsetting capability. To be concrete, it is preferable that the amorphous vinyl polymer have a molecular weight distribution divided into two groups, namely, a low molecular component and a high molecular component, and that the polymer possess at least two maximum values in a molecular weight distribution curve determined by gel permeation chromatography, namely, at least one maximum value within a range of $2\times10^3$ to $2\times10^4$ and at least one maximum value within a range of $1\times10^5$ to $1\times10^6$.

The glass transition point of the amorphous vinyl polymer Tg is preferably within a range of 50° to 100° C., particularly 50° to 85° C., in order to heighten the antiblocking property and low temperature fixability. Here, Tg means the glass transition point of the amorphous vinyl polymer in a state not bonding with the crystalline polyester.

The crystalline polyester used in the invention is not particularly limited, but polyalkylene polyester is preferred for its capability of enhancing low temperature fixability and flowability.

Examples of the polyalkylene polyester include polyethylene sebacate, polyethylene adipate, polyethylene suberate, polyethylene succinate, polyethylene-p-(carbophenoxy) undecanate, polyhexamethylene oxalate, polyhexamethylene sebacate, polyhexamethylene decandiolate, polyoctamethylene dodecanediolate, polynonamethylene azelate, polydecamethylene adipate, polydecamethylene azelate, polydecamethylene oxalate, polydecamethylene sebacate, polydecamethylene succinate, polydecamethylene octadecanediolate, polytetramethylene sebacate, polytrimethylene dodecanediolate, polytrimethylene octadecanediolate, polytrimethylene oxalate, polyhexamethylene-decamethylene-sebacate and polyoxydecamethylene-2-methyl-1,3-propane-dodecanediolate.

The melting point of the crystalline polyester Tm is preferably within a range of 50° to 120° C., particularly 50° to 100° C., in view of a high anti-blocking property and low temperature fixability. Tm used here means the melting point of the crystalline polyester in a state not bonding with the amorphous vinyl polymer.

The weight-average molecular weight of the crystalline polyester Mw ranges preferably from 5,000 to 50,000, and the number-average molecular weight thereof ranges preferably from 2,000 to 20,000, for obtaining a high anti-offsetting property.

In the invention, there is used in the mother particles a resin formed through chemical bonding between the above crystalline polyester and amorphous vinyl polymer. In said resin, the ratio of the crystalline polyester component is preferably within a range of 3 to 50 wt %, particularly 5 to 40 wt %, in order to enhance the low temperature fixability and anti-offsetting property.

There can be prepared the resin which is formed through chemical bonding between the crystalline polyester and amorphous vinyl polymer, for example, by bonding both the polymers directly in a head-tail mode, through coupling between terminal functional groups existing in each polymer, or by means of linking both the polymers through bonding between the terminal functional group of each polymer and a bifunctional coupling agent. Examples of the linkage formed by a bifunctional coupling agent include urethane linkage formed by reaction of a polymer having a terminal hydroxyl group with a diisocyanate; ester linkage formed by reaction between a polymer of terminal hydroxyl group and a dicarboxylic acid, or by reaction between a polymer having a terminal carboxyl group and a glycol; and other linkages such as reaction between a hydroxyl-terminated polymer and phosgene or dichlorodimethyl silane.

Besides the binder resin, the mother particles contain other toner components such as colorant, charge controlling agent, wax, and magnetic material, according to a specific requirement.

Useful examples of the colorant are carbon black, chrome yellow, Du Pont Oil Red, quinoline yellow, phthalocyanine blue and malachite green oxalate.

As charge controlling agent, a nigrosine dye, for example, is preferably used for its capability of imparting positive-electrification property to a toner.

Useful examples of the wax include polyolefin wax such as polyethylene or polypropylene; paraffin wax; ester-type wax, and amide-type wax.

The average size of the mother particle is preferably 5–15 μm in view of obtaining high image quality.

As magnetic material, there can be used ferromagnetic materials such as iron, cobalt, nickel; and alloys or compounds thereof such as ferrite and magnetite. These magnetic materials are used in making magnetic toners.

In the invention, a positive-electrification toner is made by fastening the above resin fine particles to the above mother particles by mechanical impact force. And the state that the resin fine particles are fastened to the surface of the mother particles means that the height of a portion of a resin fine particle projecting from the surface of a mother particle accounts for 15 to 95% of the diameter of said resin fine particle. Such a state can be easily confirmed by observing the surface of a toner particle with a transmission-type electron microscope or an ordinary electron microscope.

This state can be attained by applying, in a system where the mother particles and the resin fine particles coexist, an impact force within the range not to smash the mother particles, for example, 1/5 to 1/10 the mechanical impact force required to smash the mother particles. The magnitude of such a mechanical impact force is, though variable depending on characteristics of the binder resin contained in the mother particles, normally $1.59\times10^{-3}$ to $9.56\times10^{-5}$ erg, and preferably $1.20\times10^{-3}$ to $1.60\times10^{-4}$ erg per mother particle.

As apparatus to exert such a mechanical impact force, a super mill, ball mill and hybridizer can be used.

FIG. 1 depicts an apparatus that preforms the method of the present invention.

FIG. 1 is an illustration of a hybridizer where 1 is powder charging valve, 2 powder charging chute, 3 circular passage, 4 casing, 5 rotary board, 6 blade, 7 stator 8 jacket for heating and cooling, 9 powder discharging chute, and 10 powder discharging valve; and the arrow indicates the path of powder.

When rotary board 5 equipped with blade 6 rotates at a high speed, centrifugal force is exerted on the inside air by blade 6, and thereby the outside of rotary board 5 falls in a pressurized state and the central portion of rotary board 5 is depressurized.

Since the outside and the central portion of rotary board 5 is connected by circular passage 3, pressurized air outside of rotary board 5 moves to the central portion of rotary board 5 via circular passage 3; thus, a circular air flow is formed.

When a mixture of the mother particles and resin fine particles is charged, under the circular air flow, from powder charging chute 2 mounted in the middle of circular passage 3, said mixture starts to circulate via circular passage 3 on the circular air flow. In the course of this circulation, the mixture collides with blade 6 and gets mechanical impact force; thereby, the resin fine particles are fastened to the surface of the mother particles. After maintaining the circulation for a prescribed period of time, powder discharging valve 10 is opened to discharge the treated material using centrifugal force. In the treated particles thus prepared, the resin fine particles are firmly fastened to the surface of the mother particles.

During the circulation, circular passage 3 and powder discharge chute 9 may be heated or cooled with jacket 8 provided on the stator 7 side, in order to control the temperature inside of the apparatus.

In this hybridizer, the peripheral speed of rotary board 5 is preferably 50 to 80 m/sec, the temperature of the atmosphere is preferably 20° to 60° C., and the treating time is preferably 3 to 10 minutes.

In the invention, the treated particles prepared as above may be used as they are as positive-electrification toner. Or external additives such as inorganic fine particles or a slipping agent may be mixed in said treated particles in order to make up a positive-electrification toner. Examples of the inorganic fine particles include particles of silica, alumina, titania, barium titanate, magnesium titanate, calcium titanate, strontium titanate, zinc oxide, cerium oxide, antimony trioxide, zirconium oxide, silicon carbide, and silicon nitride. Of them, the particularly preferred is silica fine particles.

Further, for the purpose of enhancing positive-electrification property of the toner, there may be used silica fine particles which are surface-treated with amine-modified silicon compounds such as amino-modified silane coupling agent, amino-modified silicone oil and ammonium polysiloxane.

The amount of inorganic fine particles used is normally 0.01 to 5 wt %, and preferably 0.05 to 2 wt % of the total toner.

As slipping agents, there may be used zinc stearate, aluminium stearate, lithium stearate, stearic acid, and hardened castor oil. The addition amount of these slipping agents is preferably 0.01 to 2 wt % of the total toner weight.

These external additives may be incorporated together with the resin fine particles, or may be added after fastening the resin fine particles.

The positive-electrification toner of the invention may be used as two-component toner by being mixed with a carrier, or as one-component toner without being mixed with a carrier.

As carrier to make up a two-component toner, there may be employed conventional carriers; however, since the toner of the invention is positive-electrifiable, preferable carriers are those prepared by coating particles of a ferromagnetic metal such as iron, nickel or cobalt; alloy thereof; or compound thereof such as ferrite or magnetite with a fluororesin such as vinylidene fluoride-tetrafluoroethylene copolymer, polytetrafluoroethylene, poly-2,2,2-trifluoroethyl methacytlate or polypentafluoro-n-propyl methacrylate; or silicone resin. The average particle size of these carriers is preferably 20 to 200 μm, and particularly preferably 30 to 150 μm.

The positive-electrification toner of the invention is used in the hot roller fixing method which employs a hot roller covered with fluororesin.

Preferable examples of the fluororesin which constitutes the covering layer of the hot roller include polytetrafluoroethylene (PTFE) and tetrafluoroethyleneperfluoroalkyl vinylether copolymer (PFA).

In the invention, glass transition point Tg was measured with the DSC-20 (product of Seiko Electronics) according to differential scanning calorimetry. The measurement comprises steps of heating 10 mg of a sample at a temperature rising speed of 10° C./min and determining glass transition point Tg from the intersecting point of a base line and a line extrapolated from the endothermic peak curve.

Weight-average molecular weight Mw and number-average molecular weight Mn used in the invention were measured according to gel permeation chromatography (GPC), by pouring 3 mg of sample in the form of 0.2 g/20 ml tetrahydrofuran solution while flowing the solvent (tetrahydrofuran) at a flow rate of 1.2 ml/min at 40° C. In measuring molecular weight of a sample, measuring conditions were selected so as to have the molecular weight of the sample be contained within a range where the counted number and logarithms of molecular weights on an analytical curve prepared with several types of monodispersed polystyrene make a straight line.

Reliability of the measured value on the sample is confirmed by obtaining a molecular weight ratio Mw/Mn of 2.11±0.10 for NBS standard polystyrene ($Mw=28.8\times10^4$, $Mn=13.7\times10^4$, $Mw/Mn=2.11$) when subjecting it to measurement under the same conditions as with the measured sample.

In the invention, GPC columns used are not particularly limited in types as long as they meet the above conditions; usable examples include TSK-GEL, GMH (products of Tosoh Corp.). Conditions on solvents and measuring temperature are not limited to the above, they may be changed to other conditions.

Melting point Tm was measured with the DSC-20 (product of Seiko Electronics) according to differential scanning calorimetry, by taking a melting peak as melting point Tm when 10 mg of a sample was heated at a temperature rising speed of 10° C./min.

EXAMPLES

The examples of the invention will be described together with comparative examples. "Part" used below is "part by weight".

Crystalline polyester 1

In a 5-1 round bottom flask equipped with a thermometer, stainless steel stirrer, glass tube for filling nitrogen gas and condenser tube were placed 1,500 g of sebacic acid and 964 g of hexamethylene glycol. After being set on a mantle heater, the flask was heated while its inside was filled with an inactive atmosphere by introducing nitrogen gas through the nitrogen filling glass tube.

Then, 13.2 g of p-toluenesulfonic acid was added and the mixture was allowed to react at 150° C. Heating was stopped when the volume of water yielded by esterification amounted to 250 ml, and the reaction product was cooled to room temperature. Thus, crystalline polyester 1 of terminal-hydroxylic polyhexamethylene sebacate was obtained.

This crystalline polyester had a Tm of 64° C. and Mw of 14,000.

Crystalline polyester 2

Crystalline polyester 2 of polydecamethylene adipate having a Tm of 77° C. and Mw of 8,370 was prepared by the same method as with crystalline polyester 1 other than that 1,085 g of adipic acid and 1,422 g of 1,10-decanediol were used in place of sebacic acid and hexamethyline glycol.

Amorphous vinyl polymer 1

To a 1-1 separable flask was poured 100 parts of toluene and added thereto 75 parts of styrene and 25 parts of n-butyl acrylate as high-molecular-weight component monomers, as well as 0.2 part of benzoyl peroxide. After replacing the air in the flask by nitrogen, the mixture was heated to 80° C. and subjected to first polymerization for 15 hours at this temperature. Incidentally, a polymer obtained from these high-molecular-weight component monomers alone under the above conditions has a Mw of 461,000 and Tg of 61° C.

Next, the flask was cooled to 40° C., and 85 parts of styrene, 10 parts of n-butyl methacrylate and 5 parts of acrylic acid were added there to as low-molecular-weight component monomers together with 4 parts of benzoyl peroxide. After stirring the mixture for 2 hours at 40° C., temperature was raised to 80° C. again, and the mixture was then subjected to second polymerization for 8 hours at this temperature. Incidentally, a polymer obtained from these low-molecular-weight component monomers alone under the above conditions has a Mw of 8,200 and Tg of 64° C.

Subsequently, 0.5 g of zinc oxide being polyvalenlent metal compound was added in the flask, and the mixture was allowed to react for 2 hours at a refluxing temperature under stirring.

Then, the toluene was removed with an aspirator and vacuum pump. The product was amorphous vinyl polymer 1 having intermolecular ionic cross linkages formed by reaction between carboxylic groups of the vinyl polymer and zinc oxide.

The amorphous vinyl polymer prepared as above has two peaks in molecular weight distribution according to GPC; namely, a peak molecular weight of 363,000 on the high molecular weight side, and a peak molecular weight of 7,590 on the low molecular weight side. It has a Mw of 165,000, Mw/Mn of 25.9, Tg of 62° C. and softening point Tsp of 130° C.

| [Binder resin 1] | |
|---|---|
| Crystalline polyester 1 | 20 parts |
| Amorphous vinyl polymer 1 | 80 parts |
| p-Toluenesulfonic acid | 0.05 part |
| Xylene | 100 parts |

The above materials were placed in a 3-1 separable flask and refluxed for 1 hour at 150° C., and then the xylene was removed with an aspirator and vacuum pump to obtain binder resin 1 in which the crystalline polyester and amorphous vinyl polymer are chemically bonded. This binder resin has a Tg of 60° C., softening point $T_1$ of 110° C.

| [Binder resin 2] | |
|---|---|
| Crystalline polyester 1 | 15 parts |
| Amorphous vinyl polymer 1 | 85 parts |
| p-Toluenesulfonic acid | 0.05 part |
| Xylene | 100 parts |

Binder resin 2 having a Tg of 61° C. and softening point $T_1$ of 115° C. was prepared in the same manner as with binder resin 1 using the above materials.

| [Binder resin 3] | |
|---|---|
| Crystalline polyester 2 | 15 parts |
| Amorphous vinyl polymer 1 | 85 parts |
| p-Toluenesulfonic acid | 0.05 part |
| Xylene | 100 parts |

Binder resin 3 having a Tg of 62° C. and softening point $T_1$ of 118° C. was prepared in the same manner as with binder resin 1 using the above materials.

Binder resin 4

Amorphous vinyl polymer 1 was used as binder resin 4. Softening point $T_1$ of this binder resin was 130° C.

| [Mother particle 1] | |
|---|---|
| Binder resin 1 | 100 parts |
| Carbon black (MOGUL-L, product of Cabot corp.) | 10 parts |
| Paraffin wax (SASOL WAX H1, product of Sasol Chemical) | 3 parts |
| Alkylenebisaliphatic amide (Hoechst Wax C, product of Hoechst) | 3 parts |

The above materials were mixed and melt-kneaded with a heat roller. After being cooled, the kneaded product was coarsely ground, and then classified with a pneumatic classifier to obtain mother particle 1 having an average particle size of 11 μm.

Mother particle 2

Mother particle 2 having an average particle size of 11 μm was prepared in the same manner as with mother particle 1, except that binder resin 2 was used instead of binder resin 1.

| [Mother particle 3] | |
|---|---|
| Binder resin 3 | 60 parts |
| Magnetite (BL-100, product of Titan Kogyo) | 36 parts |
| Low molecular weight polypropylene (Viscol 660P, product of Sanyo Chemical) | 3 parts |
| Charge controlling agent (Oil Black SO, product of Orient Chemical) | 1 part |

The above materials were mixed and melt-kneaded with a heat roller. After being cooled, the kneaded product was coarsely ground, and then classified with a pneumatic classifier. Thus, mother particle 3 having an average particle size of 11 μm was prepared.

Mother particle 4

Mother particle 4 having an average particle size of 11 μm was prepared in the same manner as with mother particle 1, except that binder resin 4 was used instead of binder resin 1.

| [Resin fine particle 1] | |
|---|---|
| Methyl methacrylate | 37 parts |
| n-Butyl acrylate | 20 parts |
| Styrene | 40 parts |
| Sodium styrenesulfonate | 3 parts |

The above composition was polymerized in the presence of potassium persulfate (initiator) and polyvinyl alcohol (dispersion stabilizer) to prepare resin fine particle 1 having an average particle size of 0.4 μm.

Resin fine particle 1 had a frictional electrification quantity of −120 μC/g against iron powder, Tg of 60° C. and softening point $T_2$ of 140° C.

| [Resin fine particle 2] | |
|---|---|
| Methyl methacrylate | 25 parts |
| n-Butyl acrylate | 20 parts |
| Styrene | 50 parts |
| Methacrylic acid | 5 parts |

The above composition was polymerized using potassium persulfate as initiator and polyvinyl alcohol as dispersion stabilizer to obtain resin fine particle 2 having an average particle size of 0.25 μm.

Resin fine particle 2 had a frictional electrification quantity of −105 μC/g against iron powder, Tg of 62° C. and $T_2$ of 145° C.

| [Resin fine particle 3] | |
|---|---|
| Methyl methacrylate | 10 parts |
| n-Butyl acrylate | 20 parts |
| Styrene | 65 parts |
| Methacrylic acid | 5 parts |

The above composition was emulsion-polymerized using potassium persulfate as initiator and sodium dodecylbenzene sulfonate as surfactant. Resin fine particle 3 so prepared had an average particle size of 0.08 μm.

Resin fine particle 3 had a frictional electrification quantity of −150 μC/g against iron powder, Tg of 60° C. and $T_2$ of 143° C.

| [Resin fine particle 4] | |
|---|---|
| Methyl methacrylate | 60 parts |
| n-Butyl acrylate | 20 parts |
| Styrene | 20 parts |

The above composition was polymerized using potassium persulfate as initiator and polyvinyl alcohol as dispersion stabilizer. Resin fine particle 4 prepared had an average particle size of 0.25 μm.

The frictional electrification quantity of resin fine particle against iron powder was −90 μC/g, Tg was 63° C. and $T_2$ was 155° C.

| [Resin fine particle 5] | |
|---|---|
| Methyl methacrylate | 40 parts |
| n-Butyl acrylate | 20 parts |
| Styrene | 40 parts |

The above composition was polymerized using 2,2'-azobis(2-aminopropane) as initiator and polyvinyl alcohol as dispersion stabilizer. Thus, resin fine particle 5 having an average particle size of 0.4 μm was obtained.

Resin fine particle 5 had a frictional electrification quantity of +130 μC/g against iron powder, Tg of 62° C. and $T_2$ of 152° C.

Example 1

| | |
|---|---|
| Mother particle 1 | 95 parts |
| Resin fine particle 1 | 5 parts |

The above materials were thoroughly mixed with a V-type mixer to have the resin fine particles adhere to the mother particles electrostatically.

Next, the mixture was moved in the Nara Hydridization System NHS-1 (product of Nara Kikai Seisakusho), and subjected to mechanical impact force for 5 minutes under conditions of impact blade's rotating speed:6,000 rpm and wind speed:75 m/sec, to obtain treated particles in which the resin fine particles are fastened to the surface of the mother particles. The temperature of the atmosphere during the treatment was 40° C.

To 100 parts of the treated particles were added 0.8 part of silica fine particles treated with ammonium polysiloxane on the surface (hereunder referred to as surface-treated silica fine particles) and 0.1 part of zinc stearate, and they were mixed with a V-type mixer to obtain toner A of the invention. Toner A prepared had an average particle size of 11.2 μm.

By surface observation with an electron microscope and observation with a transmission-type electron microscope, it was confirmed that the resin fine particles which had electrostatically adhered to the surface of the mother particles were firmly fastened to the surface of the mother particles.

Example 2

| | |
|---|---|
| Mother particle 2 | 97 parts |
| Resin fine particle 1 | 3 parts |

From the above materials, treated particles were prepared in the same manner as in Example 1.

The treated particles were mixed with the surface-treated silica fine particles and zinc stearate as in Example 1 to obtain toner B of the invention. Toner B prepared had an average particle size of 11.2 μm. Example 3

| | |
|---|---|
| Mother particle 2 | 97 parts |
| Resin fine particle 2 | 3 parts |

From the above materials, treated particles were prepared in the same manner as in Example 1.

The treated particles were mixed with the surface-treated silica fine particles and zinc stearate as in Example 1 to obtain toner C of the invention. Toner C prepared had an average particle size of 11.1 μm.

Example 4

| | |
|---|---|
| Mother particle 2 | 97 parts |
| Resin fine particle 3 | 3 parts |

From the above materials, treated particles were prepared in the same manner as in Example 1.

The treated particles were mixed with the surface-treated silica fine particles and zinc stearate as in Example 1 to obtain toner D of the invention. Toner D prepared had an average particle size of 11 μm.

Example 5

| | |
|---|---|
| Mother particle 3 | 95 parts |
| Resin fine particle 1 | 5 parts |

From the above materials, treated particles were prepared in the same manner as in Example 1.

To 100 parts of the treated particles was added 0.5 part of the surface-treated silica fine particles used in Example 1, these were then mixed with a V-type mixer to obtain toner E of the invention. Toner E prepared had an average particle size of 11.2 μm.

| Comparison 1 | |
|---|---|
| Mother particle 2 | 97 parts |
| Resin fine particle 4 | 3 parts |

From the above materials, treated particles were prepared in the same manner as in Example 1.

Comparative toner a was prepared by incorporating the surface-treated silica fine particles and zinc stearate in the same manner as in Example 1. Comparative toner a prepared had an average particle size of 11.1 μm.

| Comparison 2 | |
|---|---|
| Mother particle 3 | 95 parts |
| Resin fine particle 4 | 5 parts |

From the above materials, treated particles were prepared in the same manner as in Example 1.

Comparative toner b was prepared by incorporating 0.5 part of the surface-treated silica fine particles of Example 1 to 100 parts of the treated particles and then by mixing them with a V-type mixer.

Comparative toner b prepared had an average particle size of 11.1 μm.

| Comparison 3 | |
|---|---|
| Mother particle 4 | 95 parts |
| Resin fine particle 1 | 5 parts |

From the above materials, treated particles were prepared in the same manner as in Example 1.

Comparative toner c was prepared by incorporating the surface-treated silica fine particles and zinc stearate in the same manner as in Example 1.

Comparative toner c prepared had an average particle size of 11.2 μm.

| Comparison 4 | |
|---|---|
| Mother particle 1 | 95 parts |
| Resin fine particle 5 | 5 parts |

From the above materials, treated particles were prepared in the same manner as in Example 1.

Comparative toner d was prepared by incorporating the surface-treated silica fine particles and zinc stearate as in Example 1.

Comparative toner d prepared had an average particle size of 11.2 μm.

Features of the toners prepared in the above examples and comparisons are shown in Table 1.

Test 1

Toners A to D according to the invention and comparative toners a to c were each mixed with a carrier having an average particle size of 80 μm and prepared by coating the surface of Cu-Zn type ferrite cores (product of Powder Tec) with 2,2,2-trifluoroethyl methacrylate, so that 2-component developers having a toner concentration of 6 wt % were prepared. Using these 2-component developers, toner image fixing test was performed on an electrophotographic copier, a modified U-Bix 1550MR (product of Konica Corp.), which is equipped with an organic photoconductive photoreceptor, developing unit for 2-component developer and hot roller fixing unit, and modified to be capable of adjusting a hot roller temperature. In the test, the hot roller's linear speed was set at 139 mm/sec, the backup roller was maintained at a temperature higher than the hot roller temperature, and the hot roller temperature was gradually changed within the range from 100° to 240° C.

The fixed toner image was rubbed on the tail portion viewed from the image's moving direction, at a prescribed load using a rubbing tester, and the residual rate of the fixed image at the tail portion was measured with a microdensitometer. Then, the low temperature fixability was evaluated by determining the lowest hot roller temperature which gave a residual rate of 80% or more (prescribed lowest fixing temperature).

The hot roller fixing unit used in this test has a 30 mm diameter hot roller having a PFA (tetrafluoroethylene-perfluoroalkyl vinylether copolymer) surface and a silicone rubber (KE-1300RTV, product of Shin-Etsu Chemical) backup roller with a PFA surface cover; its line pressure is 0.8 kg/cm, nip width is 4.3 mm, it does not have a system for dispensing a mold release such as silicone oil.

Toner E of the invention and comparative toner b were evaluated as 1-component developer. That is, unfixed toner images were formed using them on a electrophotographic copier for 1-component developer NP-3525 (product of Canon). Then, the unfixed toner images were subjected to the fixed image forming test in the same manner as in the above using the hot roller fixing unit of the above modified U-Bix 1550MR (product of Konica Corp.); the low temperature fixability was then evaluated.

Test 2

The fixed toner image forming test was carried out with an allover black original in the same manner as in Test 1, while varying the prescribed hot roller temperature.

The fixed toner images were visually examined whether marks of the fixing unit's separation nail appeared or not on the allover black portion. In Table 1 which shows the results, A means "appear" and N "not appear".

Test 3

Fixed toner images were formed in the same manner as in Test 1, except that the backup roller was maintained at a temperature close to the hot roller temperature. Immediately after that, there was visually observed, for each prescribed hot roller temperature, whether or not a toner stain was made on white transfer paper by feeding it to the hot roller fixing unit under the same conditions as in the above. Thus, there was determined the lowest prescribed hot roller temperature at which a toner stain began to come about (offset generation temperature).

Test 4

Using the 2-component developers of Test 1, a copying test of 100,000 cycles was carried out with an electrophotographic copier U-Bix 1017 (product of Konica Corp.) whose hot roller was maintained at a prescribed temperature of 140° C., under high temperature and high humidity conditions (33° C., 80% RH) as well as under low temperature and low humidity conditions (10° C., 20% RH), and the images were visually evaluated.

On the other hand, the 1-component developers used in Test 1 were subjected to a copying test of 100,000 cycles on an electrophotographic copier NP-3525 (product of Canon) whose hot roller was maintained at a prescribed temperature of 150° C., under the high temperature and high humidity conditions and under the low temperature and low humidity conditions identical with the above. The images obtained were visually evaluated.

The results of the above tests are shown in Table 1.

TABLE 1

| | | Mother particle | | Resin fine particle | | | | | | |
|---|---|---|---|---|---|---|---|---|---|---|
| | Toner No. | No. | $T_1$ | No. | $T_2$ | Frictional electrification quantity | Lowest fixing temperature (°C.) | Mark of fixing unit's separation nail | Offset generation temperature (°C.) | Image quality |
| Example 1 | Toner A | 1 | 110° C. | 1 | 140° C. | −120 μC/g | 135 | N | 190 | Good till 100,000 cycles under conditions of both high temp. & high humidity and high temp. & high humidity |
| Example 2 | Toner B | 2 | 115° C. | 1 | 140° C. | −120 μC/g | 145 | N | 200 | Good till 100,000 cycles under conditions of both high temp. & high humidity and high temp. & high humidity temp. & high humidity |
| Example 3 | Toner C | 2 | 115° C. | 2 | 145° C. | −105 μC/g | 140 | N | 210 | Good till 100,000 cycles under conditions of both high temp. & high humidity and high temp. & high humidity |
| Example 4 | Toner D | 2 | 115° C. | 3 | 143° C. | −150 μC/g | 140 | N | 210 | Good till 100,000 cycles under conditions of both high temp. & high humidity and high temp. & high humidity |
| Example 5 | Toner E | 3 | 118° C. | 1 | 140° C. | −120 μC/g | 145 | N | 200 | Good till 100,000 cycles |

TABLE 1-continued

| | Toner No. | Mother particle No. | Mother particle $T_1$ | Resin fine particle No. | Resin fine particle $T_2$ | Frictional electrification quantity | Lowest fixing temperature (°C.) | Mark of fixing unit's separation nail | Offset generation temperature (°C.) | Image quality |
|---|---|---|---|---|---|---|---|---|---|---|
| | | | | | | | | | | under conditions of both high temp. & high humidity and high temp. & high humidity |
| Comparison 1 | Comparative toner a | 2 | 115° C. | 4 | 155° C. | −90 μC/g | 150 | A | 175 | Image stain due to stained roller was generated after 20,000 cycles, increased fogging after 40,000 cycles |
| Comparison 2 | Comparative toner b | 3 | 118° C. | 4 | 155° C. | −90 μC/g | 145 | A | 175 | Image stain due to stained roller was generated after 20,000 cycles, increased fogging after 40,000 cycles |
| Comparison 3 | Comparative toner c | 4 | 130° C. | 1 | 140° C. | −120 μC/g | 185 | N | 240 | Poor fixability, frequent offsetting |
| Comparison 4 | Comparative toner d | 1 | 110° C. | 5 | 152° C. | +130 μC/g | 145 | a | 160 | Image stain due to stained roller was generated after 2,000 cycles, increased fogging after 5,000 cycles |

As apparent from Table 1, toners A to E of the invention are good in low temperature fixability and anti-offsetting capability, and have a broad correct fixing temperature range. They formed images of good quality over 100,000 cycles of copying in environments of both high temperature and high humidity and high temperature and high humidity, causing none of poor cleaning, image failure and fogging. Moreover, in testing them, there were observed neither toner blocking in the developing unit and cleaning unit, nor filming on the photoreceptor and developing sleeve; staining of the hot roller was very little.

On the contrary, comparative toners a and b caused clear marks of the fixing unit's separation nail on the allover black paper, in addition to offsetting at lower temperatures which indicates poor demolding capability. In the copying test of 100,000 cycles, substantial hot roller stains due to electrostatic offsetting were caused and thereby images were stained after 20,000 cycles; and low temperature and low humidity. In the environment of high temperature and high humidity, fogging increased after 40,000 cycles, and thereby image quality was gradually deteriorated.

With comparative toner c, fixability was poor from the initial stage of copying, and the fixed toner readily peeled off from the transfer paper. Further, substantial offsetting was observed.

Comparative toner d was very poor in capabilities of demolding and anti-offsetting. In the copying test, a heavy hot roller stain due to electrostatic offsetting that was accompanied by poor image quality was observed after 2,000 cycles. After 5,000 cycles, fogging became heavy and image quality was sharply lowered.

As described above in detail, the positive electrification toner of the invention exhibits, when applied to the hot roller fixing image forming process using a fluororesin-covered hot roller, an excellent capabilities in low temperature fixing, antiblocking, anti-offsetting and cleaning as well as a high electrostatic offsetting resistance and durability.

What is claimed is:

1. A positive-electrification toner comprising:

(1) mother particles containing a resin and a coloring agent, in which resin a crystalline polyester and an amorphous vinyl polymer are chemically bonded, wherein the softening point of the binder resin of the mother particle is 90° to 130° C., and (2) vinyl resin fine particles fastened to the mother particles by mechanical impact force, wherein the resin has a softening point higher than that of the resin contained in the mother particles and not higher than 160° C. and the vinyl resin fine particles have a frictional negative electrification quantity against iron powder larger than 100 μc/g in an absolute value.

2. A positive-electrification toner as claimed in claim 1, wherein an average particle size of the vinyl resin fine particles is 0.02 to 0.6 μm.

3. A positive-electrification toner as claimed in claim 1, wherein the vinyl resin is styrene/methyl methacrylate/n-butylacrylate copolymer, styrene/methyl methacrylate/n-butyl acrylate/methacrylic acid copolymer or styrene/methylmethacrylate/n-butylacrylate/sodium styrenesulfonate copolymer.

4. A positive-electrification toner as claimed in claim 1, wherein the vinyl resin fine particles have a frictional negative electrification quantity against iron powder smaller than 200 μc/g in an absolute value.

5. A positive-electrification toner as claimed in claim 1, wherein the softening point of the resin of fine particles $T_2$ is 10° to 60° C. higher than the softening point of the resin of mother particles $T_1$.

6. A positive-electrification toner as claimed in claim 1, wherein a cover ratio of the mother particles with the resin fine particles 10 to 90%.

7. A positive-electrification toner as claimed in claim 1, wherein an average particle size of mother particles is 5 to 15 μm.

8. A positive-electrification toner as claimed in claim 1 wherein the toner is capable being fixed with a hot roller having a fluoro-resin covering layer.

9. A positive-electrification toner capable being fixed with a hot roller having a fluoro-resin covering layer comprising;

(1) mother particles containing a resin and a coloring agent, in which resin a crystalline polyester and an amorphous vinyl polymer are chemically bonded and the softening point of binder resin of the mother particle is 90° to 130° C., and (2) vinyl resin fine particles fastened to the mother particles by mechanical impact force, wherein the resin has a softening point higher than that of the resin contained in the mother particles and not higher than 160° C. and the vinyl resin fine particles have a frictional negative electrification quantity against iron powder of 100 μc/g to 200 μc/g in an absolute value, wherein the softening point of the resin of fine particles $T_2$ is 10° to 60° C. higher than the softening point of the resin of mother particles $T_1$.

* * * * *

UNITED STATES PATENT AND TRADEMARK OFFICE

CERTIFICATE OF CORRECTION

PATENT NO. : 5,225,304

DATED : July 06, 1993

INVENTOR(S) : Hirotaka Kabashima et al.

It is certified that error appears in the above-indentified patent and that said Letters Patent is hereby corrected as shown below:

Title page,
item [57],
Abstract, Title Page, last line change "electroststic" to --electrostatic--.

Claim 6, column 18, line 57, after "particles" insert --is--.

Claim 8, column 18, line 62, after "capable" insert --of--.

Claim 9, column 18, line 64, after "capable" insert -- of--.

Signed and Sealed this
Fifth Day of April, 1994

Bruce Lehman

BRUCE LEHMAN

*Commissioner of Patents and Trademarks*

*Attest:*

*Attesting Officer*